US007756430B1

(12) United States Patent
Chang et al.

(10) Patent No.: US 7,756,430 B1
(45) Date of Patent: Jul. 13, 2010

(54) APPARATUS AND METHOD FOR CHARGING AN IMAGING MEMBER

(75) Inventors: Seongsik Chang, Palo Alto, CA (US); Omer Gils, Palo Alto, CA (US); William D. Holland, Palo Alto, CA (US); Michael H. Lee, Palo Alto, CA (US); Boaz Tagansky, Palo Alto, CA (US); Gadi Oron, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 730 days.

(21) Appl. No.: 11/413,852

(22) Filed: Apr. 27, 2006

(51) Int. Cl.
*G03G 15/02* (2006.01)

(52) U.S. Cl. ..... 399/50; 399/159; 399/168; 399/169; 399/176

(58) Field of Classification Search ..... 399/50, 399/159, 168, 169, 176
See application file for complete search history.

(56) References Cited

U.S. PATENT DOCUMENTS 4,286,866 A 9/1981 Stelben et al.
4,696,562 A * 9/1987 Urata et al. ..... 399/377
5,448,343 A * 9/1995 Nakamichi et al. ..... 399/313
6,633,735 B2 10/2003 Kellie et al.
2003/0072587 A1 4/2003 Surgiura et al.
2003/0190539 A1 10/2003 Niimi
2005/0095035 A1 5/2005 Vejtasa et al.
2005/0095036 A1 5/2005 Gila et al.
2005/0129426 A1 * 6/2005 Tsunemi et al. ..... 399/159

FOREIGN PATENT DOCUMENTS

JP 61140962 A * 6/1986

OTHER PUBLICATIONS

English Abstract of JP 61140962A to Saito.*

* cited by examiner

*Primary Examiner*—David M Gray
*Assistant Examiner*—Ryan D Walsh

(57) ABSTRACT

A method of charging an imaging member having an outer surface with an imaging region and a seam region. A charge device is provided adjacent the imaging member. An electrical charge is provided to the imaging region of the imaging member using a voltage on the charge device. An other electrical charge is provided to the seam region of the imaging member using an other voltage on the charge device.

21 Claims, 5 Drawing Sheets

APPARATUS AND METHOD FOR CHARGING AN IMAGING MEMBER

BACKGROUND OF THE INVENTION

The present invention generally relates to image transfer technology and, more particularly, to an apparatus and method for charging imaging members of image transfer devices during the printing process, and an image transfer device utilizing the apparatus and method.

As used herein, the term "image transfer device" generally refers to all types of devices used for creating and/or transferring an image in an electrophotographic process, including laser printers, copiers, facsimiles, and the like. As used herein, the term "electrophotographic process" includes both dry and liquid electrophotographic (LEP) processes.

In an electrophotographic image transfer device, the surface of a photoconducting material (i.e., a photoreceptor) is charged to a substantially uniform electrostatic potential so as to sensitize the surface. An electrostatic latent image is created on the surface of the charged photoconducting material by selectively exposing areas of the photoconductor surface to a light image of the original document being reproduced. A difference in electrostatic charge density is created between the areas on the photoconductor surface exposed and unexposed to light. For example, in a liquid electrophotographic process, the photoconductor surface is initially charged to approximately −1000 Volts, with the exposed photoconductor surface discharged to approximately −50 Volts. Alternatively, the photoconductor surface can be initially charged to 1000 Volts, with the exposed surface discharged to approximately 50 Volts.

The electrostatic latent image on the photoconductor surface is developed into a visible image using electrostatic toners or pigments. The toners are selectively attracted to the photoconductor surface either exposed or unexposed to light, depending on the relative electrostatic charges of the photoconductor surface, development electrode, and toner. The photoconductor surface may be either positively or negatively charged, and the toner system similarly may contain negatively or positively charged particles.

A sheet of paper or other medium is passed close to the photoconductor surface, which may be in the form of a rotating drum or belt, transferring the toner from the photoconductor surface onto the paper in the pattern of the image developed on the photoconductor surface, thereby forming a hard image. The transfer of the toner may be an electrostatic transfer, as when the sheet has an electric charge opposite that of the toner, or may be a heat transfer, as when a heated transfer roller is used, or a combination of electrostatic and heat transfer. In some printer embodiments, the toner may first be transferred from the photoconductor surface to an intermediate transfer medium, and then from the intermediate transfer medium to a sheet of paper.

Charging of the photoconductor surface may be accomplished by any of several types of charging devices, such as a corotron (a corona wire having a DC voltage and an electrostatic shield), a dicorotron (a glass covered corona wire with AC voltage, and electrostatic shield with DC voltage, and an insulating housing), a scorotron (a corotron with an added biased conducting grid), a discorotron (a dicorotron with an added biased conducting strip), a pin scorotron (a corona pin array housing a high voltage and a biased conducting grid), or a charge roller. A charge roller has been observed to provide adequate electrical charge with the associated benefits of saving space along a surface of the photoconductor, as well as a reduction in maintenance.

Charge rollers having a variety of designs are known in the art. Some charge rollers are made of a conductive elastomeric material, commonly urethane, molded over a metal core. The charge roller may be lightly pressed against a photoconductor surface to maintain a constant footprint and therefore provide more consistent charging. In some configurations, steady pressure against the photoconductor surface may not be desirable to maintain a constant footprint. For example, some photoconductor configurations have a seam region wherein a photoconductor sheet is inserted into a drum surface and attached. The drum may have a depression in the seam region so that the seam region of the photoconductor does not protrude farther than the radius of the photoconductor and be subject to mechanical damage by contact with other image transfer device components. However, in a liquid electrophotographic implementation, imaging oil may accumulate within the seam region of the photoconductor. Print defects may result in the hard image if the charge roller picks up oil from the seam region and deposits it on other portions of the surface of the photoconductor. In dry electrophotographic processes, potentially damaging electrical arcing may occur if the charge roller enters the seam region of the photoconductor. Accordingly, it is desirable to reduce or avoid entry of the charge roller into the depressed seam region.

However, if the charge roller comes out of contact with the photoconductor and does not enter the seam region, then the photoconductor is not charged in the seam region. Not charging the photoconductor in the seam region is equivalent to exposing the photoconductor with light, so during development of the latent image, toners and pigments are undesirably attracted to the uncharged seam region. Although the toners and pigments are cleaned from the seam region, there is a resultant wasting of materials that increases the cost of printing.

SUMMARY OF THE INVENTION

The invention described herein provides a method of charging an imaging member. In one embodiment, the method comprises: providing an imaging member having an outer surface with an imaging region and a seam region; providing a charge device adjacent the imaging member; providing an electrical charge to the imaging region of the imaging member using a voltage on the charge device; and providing an other electrical charge to the seam region of the imaging member using an other voltage on the charge device.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
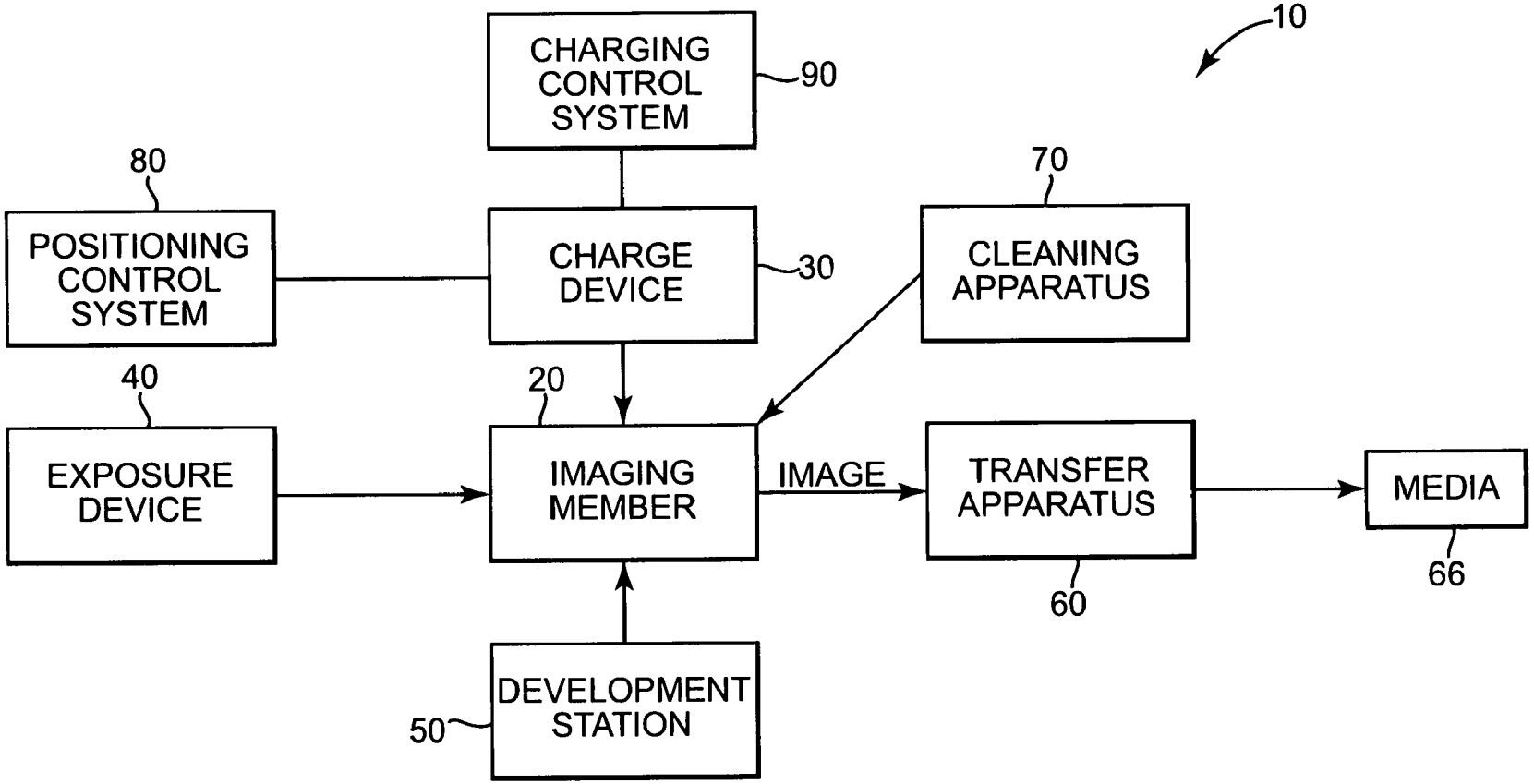
FIG. 1 is a functional block diagram of an image transfer device according to one embodiment.
Figure 2:
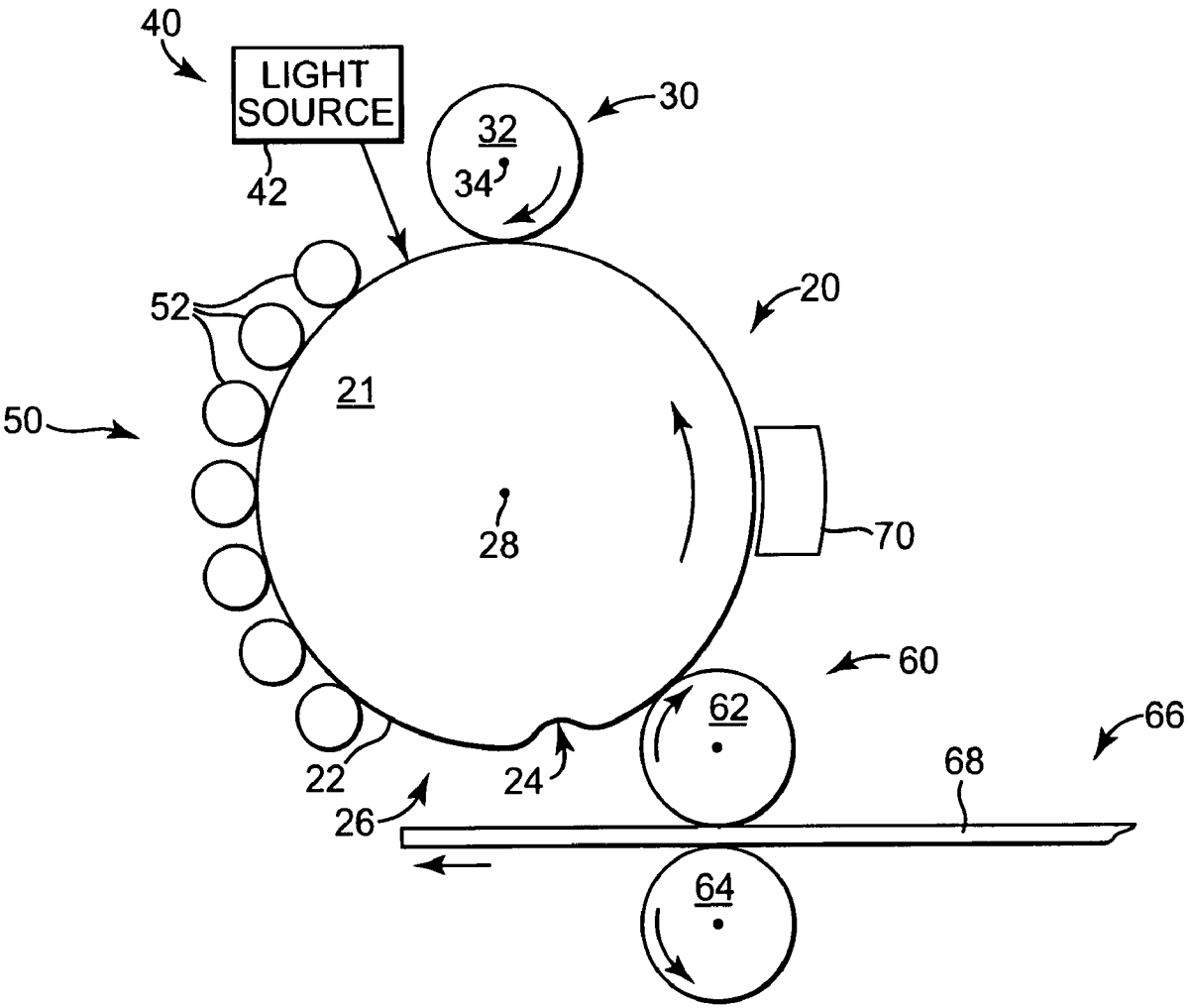
FIG. 2 is a schematic representation of an image transfer device according to one embodiment.

Referring to FIGS. 1 and 2, details regarding an exemplary configuration of an image transfer device 10 configured to implement electrophotographic imaging operations according to one embodiment are shown. The depicted image transfer device 10 includes an imaging member 20, a charge device 30, an exposure device 40, a development station 50, an image transfer apparatus 60, a cleaning apparatus 70, a positioning control system 80, and a charging control system 90. Other configurations are possible, including more, less, or alternative components. Although, for purpose of clarity, embodiments according to the invention are illustrated and described herein with respect to a liquid electrophotographic (LEP) printer having a photoconductor surface, the invention is understood to be applicable and useful with other embodiments of image transfer devices 10 and imaging members 20, including image transfer devices utilizing dry electrophotographic processes.

Imaging member 20 may comprise an outer surface with plural portions or regions of different radii. For example, imaging member 20 may comprise a photoconductor embodied as a drum 21 (FIG. 2) having photoconductor sheet as the outer surface 22, wherein ends of the sheet may be provided adjacent to one another at a seam region 24.

As described below, the outer surface 22 may have a different radius at seam region 24 compared with an imaging region 26 of the outer surface 22. In the exemplary embodiment shown in FIG. 2, the outer surface 22 has a smaller radius at seam region 24 compared with imaging region 26. The illustrated seam region 24 is provided to depict aspects of the disclosure, and the seam region 24 may be smaller or larger in actual implementations. Imaging region 26 may refer to portions of the outer surface 22 wherein images are formed and developed as described further below (e.g., in one embodiment imaging region 26 may comprise the remaining portions of the outer surface 22 apart from seam region 24).

The imaging member 20 may rotate about an axis 28, wherein portions of outer surface 22 pass adjacent to charge device 30, exposure device 40, development station 50, image transfer apparatus 60, and cleaning apparatus 70. Other configurations of imaging member 20 (e.g., a photoconductor belt) are possible in other embodiments.

Charge device 30 is configured to provide an electrical charge (typically −500 to −1000 V or 500 to 1000 V) to seam region 24 and imaging region 26 of imaging member 20. Charge device 30 is embodied as a charge roller 32 in the exemplary embodiment shown in FIG. 2. Commonly, charge roller 32 consists of a conductive support shaft (not shown) with a conductive polymer material surrounding the support shaft. In one embodiment, charge roller 32 is configured to rotate about axis 34 and contact imaging region 26 of imaging member 20 to provide the electrical charge to imaging region 26, and to be spaced from seam region 24 to provide the electrical charge to seam region 24. In another embodiment, charge roller 32 is spaced from but proximately located adjacent to seam region 24 and imaging region 26 to affect charging of seam region 24 and imaging region 26. Other configurations may be provided to implement charging of seam region 24 and imaging region 26 by charge roller 32. When charging of the photoconductor begins, surface 22 is at an electric charge lower than the desired charge. As charge roller 32 moves into close proximity with surface 22, the surface 22 becomes charged.

Voltage is supplied to charge roller 32 in any of various ways known in the art. The voltage may result from a DC voltage source, or a combination of DC and AC voltage sources. Charge roller 32 is biased by the voltage source to a predetermined electric potential sufficient to create the desired potential on surface 22 of imaging member 20, for example approximately −1500 to −1000 Volts. If a DC voltage is used alone, charge roller 32 has a shaft voltage that is commonly approximately 540 V higher than the desired charge of surface 22. When an additional AC voltage is supplied, the DC bias is usually close to the desired charge of surface 22, with an AC amplitude of 540 V peak or more. The addition of AC voltage usually creates a more uniform charge layer on surface 22 by adding to or subtracting from the charge on surface 22 as needed. When running a charge roller in AC mode at high speeds (in the range of 1 m/s and faster), an AC frequency of at least 6 KHz may be used to maintain a smooth and even charge on surface 22.

In some embodiments, more than one charge device 30 is provided adjacent imaging member 20 for incrementally increasing the electric potential of seam region 24 and imaging region 26. In other embodiments, only a single charge device 30 is provided. The number of charge devices 30 will be affected by factors including the process speed of the outer surface 22 and the desired electric potential of seam region 24 and imaging region 26 of imaging member 20.

Exposure device 40 is configured to discharge the electrical charge on the imaging member 20 at selected locations corresponding to a desired image to be formed. The discharging of the electrical charge provides a latent image upon the imaging region 26 of the imaging member 20. In one embodiment, exposure device 40 may be implemented as a light source 42 (such as a laser) that forms an electrostatic latent image on imaging region 26 by scanning a light beam according to the image to be formed. The electrostatic latent image is due to a difference in the surface potential between the exposed and unexposed portion of imaging region 26. Exposure device 40 exposes images on imaging region 26 corresponding to various colors, for example, yellow (Y), magenta (M), cyan (C) and black (K), respectively.

Development station 50 is configured to provide a marking agent, such as liquid ink in a liquid configuration or dry toner in a dry configuration. The marking agent may be electrically charged and attracted to the discharged locations of the imaging region 26 of the imaging member 20 corresponding to the latent image to develop the latent image. In one embodiment, development station 50 supplies development liquid, which is a mixture of solid electrostatic toners or pigments dispersed in a carrier liquid (such as Isopar) serving as a solvent (referred to herein as "imaging oil"), to surface 22 of imaging member 20 to adhere the toner to the portion of imaging region 26 where the electrostatic latent image is formed, thereby forming a visible toner image on surface 22 of imaging member 20. In one embodiment, development station 50 may include a plurality of development rollers 52 which may provide marking agents of different colors corresponding to the color images exposed by exposure device 40. The carrier liquid is typically electrically insulative.

Image transfer apparatus 60 is configured to transfer the marking agent of the developed image formed upon imaging member 20 to media 66. In one embodiment, image transfer apparatus 60 includes an intermediate transfer drum 62 in contact with surface 22 of imaging member 20, and a fixation or impression drum 64 defining a nip with transfer drum 62.

As transfer drum 62 is brought into contact with surface 22, the marking agent of the developed image is transferred from surface 22 to transfer drum 62. Media 66, such as a sheet of paper, is fed into the nip between transfer drum 62 and impression drum 64 to transfer the marking agent defining the image from transfer drum 62 to media 66, which may be for example a sheet of paper 68. Impression drum 64 fuses the toner image to media 66 by the application of heat and pressure.

Cleaning apparatus 70 is configured to remove any marking agent which was not transferred from surface 22 of imaging member 20 to transfer drum 62 prior to recharging by charge device 30. In one embodiment, cleaning apparatus 70 may apply imaging oil to surface 22 of imaging member 20 to assist with the removal of residual marking agent. In one embodiment according to the invention, the cleaning fluid is imaging oil as used by development station 50. As surface 22 of imaging member moves past cleaning apparatus 70, some residual imaging oil and marking agent may remain within seam region 24, which may result in imaging defects if contacted by charge device 30.

Positioning control system 80 (FIG. 1) is configured to control a position of one or both of charge device 30 and imaging member 20 relative to the other. Positioning control system 80 may be configured to implement operations to control the relative positions corresponding to regions or portions of surface 22 of imaging member 20. For example, in one embodiment positioning control system 80 may operate to maintain a substantially constant distance between respective axes 28, 34 of the imaging member 20 and charge device 30, respectively. In one embodiment, positioning control system 80 may operate to space charge device 30 from seam region 24 of imaging member 20. One exemplary positioning control system 80 suitable for controlling the relative position of charge device 30 and imaging member 20 is disclosed in U.S. patent application Ser. No. 10/997,033, filed on Nov. 24, 2004, titled "Imaging Methods, Imaging Member Charging Methods, and Image Engine," commonly assigned herewith and incorporated herein by reference.

Charging control system 90 (FIG. 1) is configured to control a voltage of charge device 30, and thereby control the electrical charge imparted to seam region 24 and imaging region 26 of imaging member 20. Charging control device 90 may be configured to implement operations to control the voltage of charge device 30 corresponding to regions or portions of surface 22 of imaging member 20. For example, in one embodiment charging control system 90 may operate to provide a voltage to charge device 30 when imaging region 26 is adjacent charge device 30, and provide another voltage to charge device 30 when seam region 24 is adjacent charge device 30. Charging control device 90 may be configured to implement operations to adjust the voltage of charge device 30 corresponding to the relative position of imaging member 20 and charge device 30. For example, in one embodiment charging control system 90 may operate to provide a voltage to charge device 30 when charge device 30 is contacting surface 22 of imaging member 20, and provide another voltage to charge device 30 when charge device 30 is spaced from surface 22 of imaging member 20.

Figure 4:
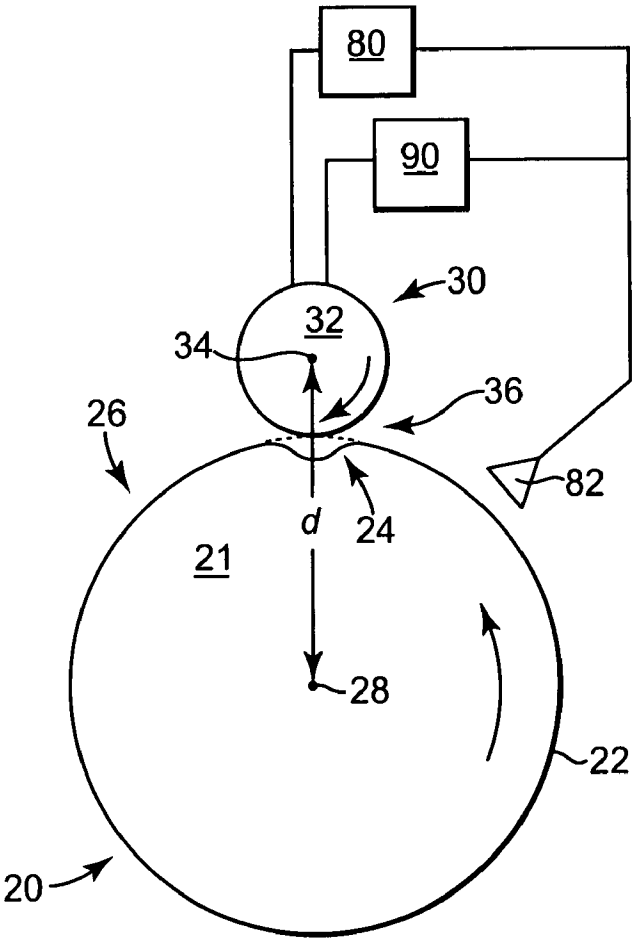
FIG. 4 is another schematic representation of an imaging member and a charge device according to one embodiment.
Figure 3:
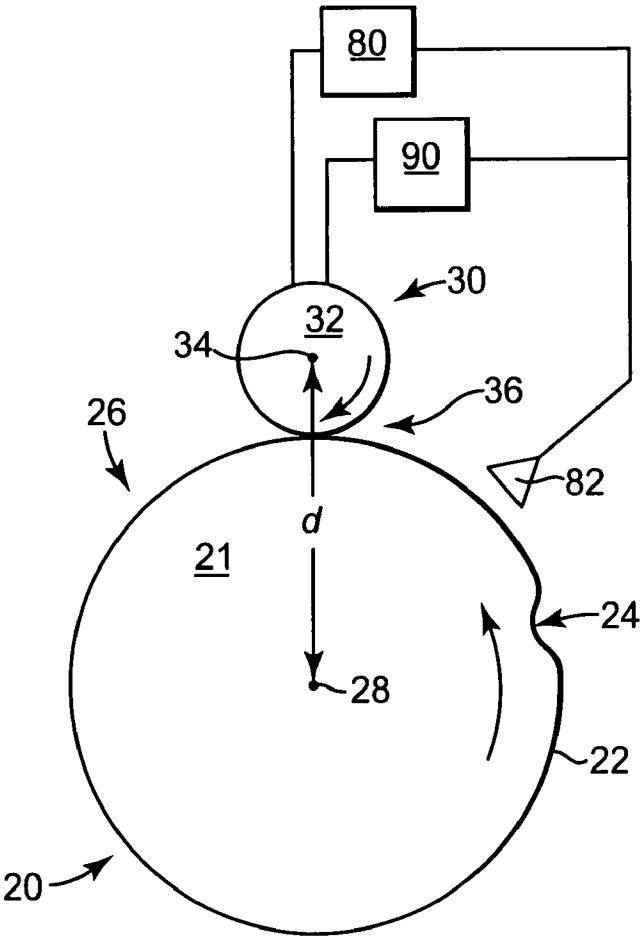
FIG. 3 is a schematic representation of an imaging member and a charge device according to one embodiment.
Figure 5:
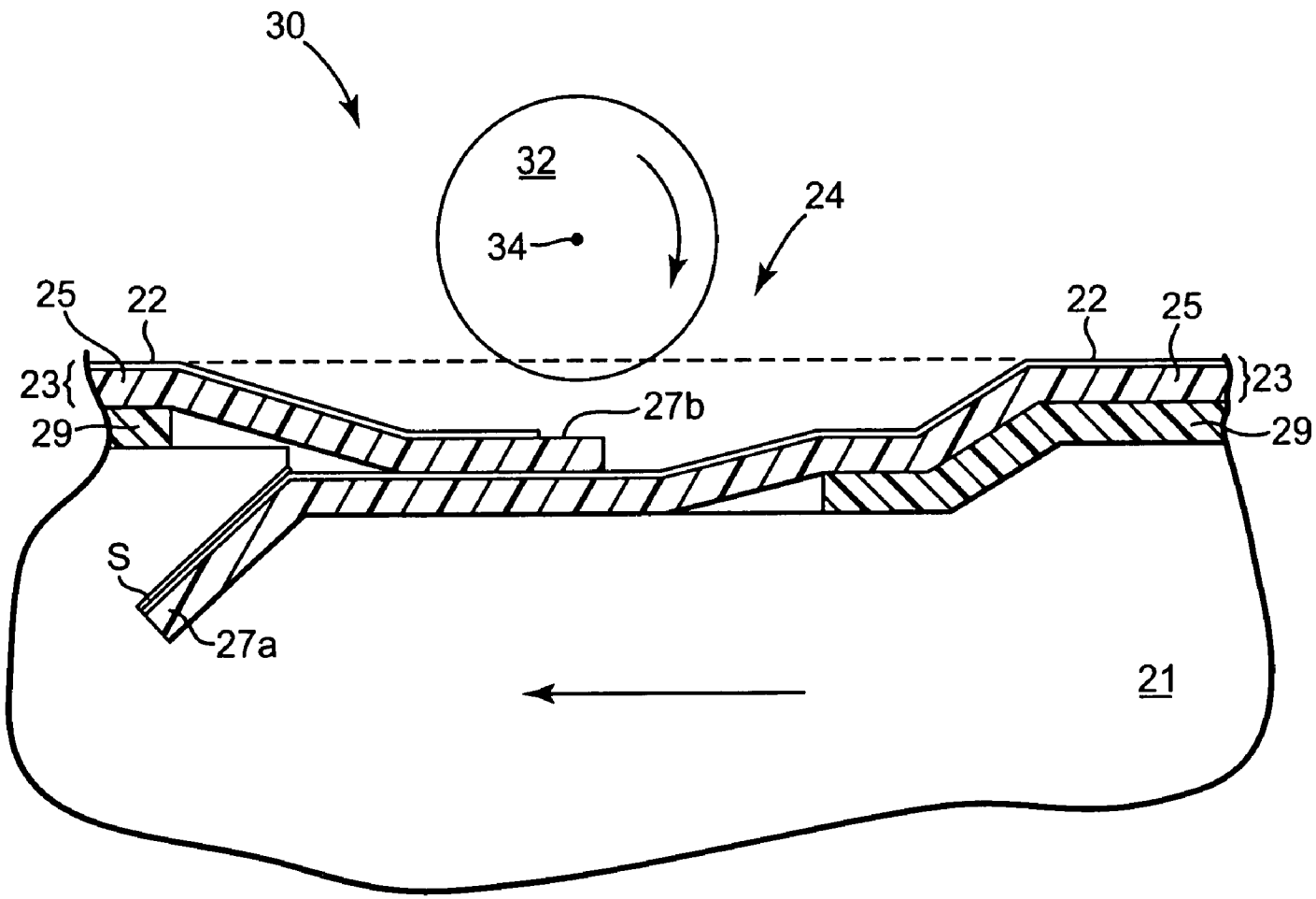
FIG. 5 is an enlarged seam region of an imaging member according to one embodiment.

Referring now to FIGS. 3-5, exemplary details are described with respect to control of the positional relationship of imaging member 20 and charge device 30 by positioning control system 80, and control of the voltage of charge device 30 by charging control system 90 according to one embodiment. In the embodiment of FIGS. 3-5, charge device 30 is embodied as charge roller 32 which is configured to contact and rotate with imaging region 26 of imaging member 20 (FIG. 3) and to be provided in a spaced relationship with respect to seam region 24 (FIGS. 4 and 5).

FIG. 5 illustrates a greatly enlarged exemplary embodiment of seam region 24, where drum 21 of imaging member 20 has photoconductor sheet 23 wrapped about the circumference thereof. Photoconductor sheet includes outer photoconductive surface 22 on a base film 25, for example mylar. A first end 27*a* of sheet 23 is retained in a slot S of drum 21, while a second end 27*b* of sheet 23 overlaps sheet 23 in seam region 24 adjacent first end 27*a*. A cushioning substrate 29 may be provided between drum 21 and sheet 23. Charge roller 32 is illustrated extending slightly into seam region 24 (i.e., below the level of the dashed line). Charge roller 32 may extend slightly into seam region 24 due to relaxation of charge roller 32. That is, as charge roller 32 approaches seam region 24, charge roller 32 is touching and compressed against surface 22 of imaging member 20. As charge roller 32 enters seam region 24 and disengages surface 22, charge roller 32 may expand slightly as any compression forces are removed.

Referring again to FIGS. 3 and 4, imaging member 20 and charge roller 32 may form a nip at a nip location 36, wherein charging of seam region 24 and imaging region 26 occurs at nip location 36. In the illustrated embodiment, a sensor 82 is configured to monitor rotation of imaging member 20. For example, sensor 82 may provide a signal which indicates seam region 24 approaching nip location 36. The signal from sensor 82 may be used by positioning control device 80 to control the position of charge roller 32 (i.e., restricting movement of charge roller 32 into seam region 24) responsive to seam region 24 reaching nip location 36. The signal from sensor 82 may also be used by charging control device 90 to control the voltage of charge roller 32 (i.e., increasing the voltage on charge roller 32) responsive to seam region 24 reaching nip location 36. Accordingly, in one embodiment, a position and voltage of charge roller 32 is controlled with respect to one portion of outer surface 22 (e.g., imaging portion 26) of imaging member 20 at one moment in time, and is controlled with respect to another portion of outer surface 22 (e.g., seam portion 24) of imaging member 20 at another moment in time. In one embodiment, the position of axis 34 and charge roller 32 is substantially the same during full rotations of imaging member 20 and charge roller 32.

In the illustrations of FIGS. 3-4, charge roller 32 is shown oriented elevationally above imaging member 20, with axis 34 of charge roller 32 located directly over axis 28 of imaging member 20. In other embodiments, imaging member 20 and charge roller 32 may be offset with respect to each other, such that axes 28, 34 are not vertically aligned. In accordance with one embodiment, the position of axis 28 of imaging member 20 may be fixed, while axis 34 of charge roller 32 may be configured to move. In other embodiments, axis 34 may be fixed and axis 28 may be configured to move, or both axes 28, 34 may move.

It is beneficial to reduce or avoid entry of charge roller 32 into seam region 24. Charge roller 32 may contact accumulated imaging oil and/or marking agent remaining from the cleaning step within the seam region 24, which may result in imaging defects or otherwise degrade imaging quality and/or increase the chances of arcing between charge roller 32 and a ground plane of the imaging member 20. Accordingly, positioning control system 80 may be used to reduce or avoid entry of charge roller 32 into seam region 24, and thereby reduce or avoid transferring residual imaging oil from seam region 24 to charge roller 32. Even if seam region 24 is free of residual imaging oil and marking agent, it is beneficial to reduce or avoid entry of charge roller 32 into seam region 24 to prevent bouncing of charge roller 32. If surface 22 is moving sufficiently fast (in excess of, for example, approximately 0.3 meters/second), the length of seam region 24 is too short to permit charge roller 32 to smoothly enter and exit seam region 24, thereby causing charge roller 32 to bounce against imaging member 20. Bouncing of charge roller 32 may result in damage to one or both of charge roller 32 and imaging member 20, or may result in imaging defects or otherwise degrade imaging quality.

In one embodiment, positioning control device 80 may be used to maintain a substantially constant distance "d" between axes 28, 34 during rotations of imaging member 20 and charge roller 32, including moments in time wherein charge roller 32 contacts imaging region 26, as well as moments of time when charge roller 32 is spaced from seam region 24. Distance "d" may vary slightly over time, corresponding to fluctuations in diameter of one or both of imaging member 20 and charge roller 32 due to, for example, environmental conditions such as humidity. Accordingly, the substantially constant distance refers to temporally related moments in time, for example during imaging of one or more temporally related imaging jobs, and is not intended to refer to the lifetimes of image transfer device 10, imaging member 20, or charge roller 32.

When charge roller 32 comes out of contact with surface 22 and is spaced from seam region 24, the air gap between charge roller 32 and surface 22 causes an increase of the air breakdown threshold voltage ($V_{th}$). Thus, the photoconductor surface 22 is not charged in seam region 24, or a lesser charge is provided to seam region 24 than imaging region 26. If the charge in seam region 24 is less than the charge of development rollers 52 (FIG. 2), marking agents will be attracted to seam region 24. Therefore, to reduce the attraction of marking agents to seam region 24, it is desirable to provide seam region 24 with an electric potential at least equal to the electric potential of development rollers 52. The larger the difference between the charge of seam region 24 and development rollers 52, the less marking agents will be attracted to seam region 24.

Because of the air gap between charge roller 32 and surface 22 in seam region 24, a higher voltage on charge roller 32 is required to charge the photoconductor surface 22 in seam region 24. In one exemplary implementation, the air gap between charge roller 32 and surface 22 in seam region 24 is about 230 μm. For a 230 μm gap, the air breakdown threshold voltage $V_{th}$=1500 V. Because of voltage divisions among the air gap and the photoconductor, the gap voltage ($V_g$) is only a portion of the charge roller voltage ($V_{CR}$). The gap roller voltage $V_g$ is given by the equation:

$$V_g = V_{CR}\frac{g}{g + \frac{d_{OPC}}{\varepsilon_{r\text{-}OPC}}}$$

where g is the air gap between the organic photoconductor (OPC) and the charge roller, $d_{OPC}$ is the thickness of the organic photoconductor, and $\in_{r\text{-}OPC}$ is the relative dielectric constant of the organic photoconductor.

Figure 6:
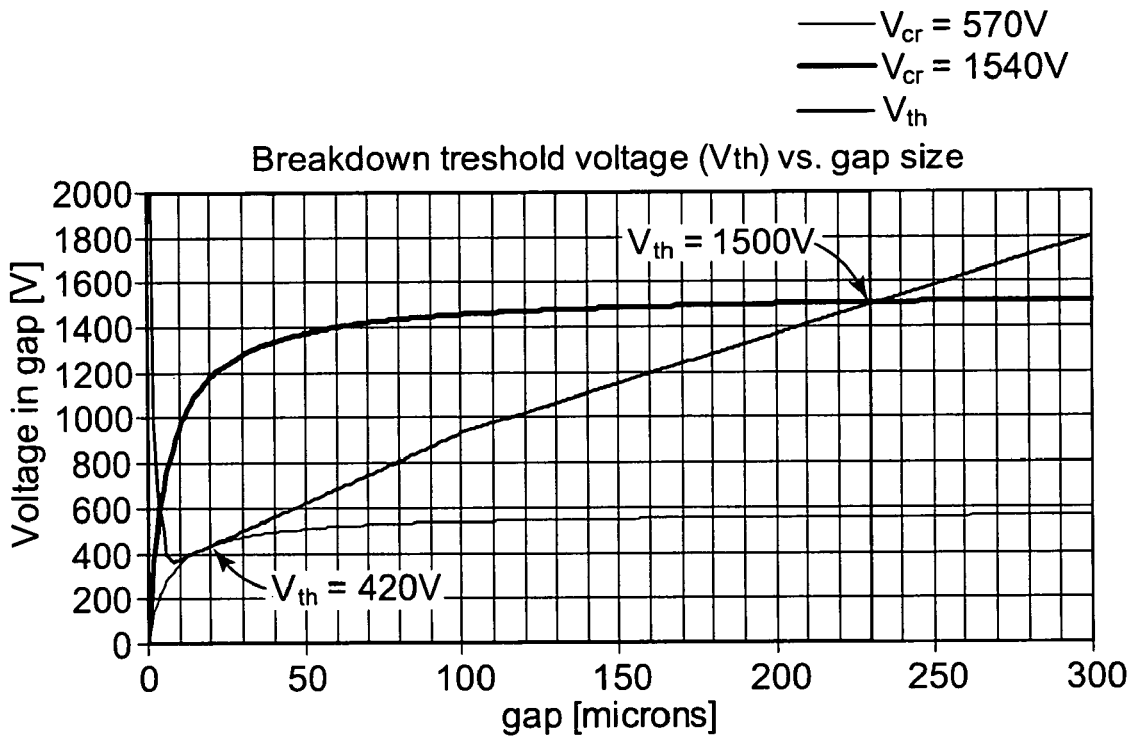
FIG. 6 is a graph of gap voltage as a function of gap distance according to one embodiment.

FIG. 6 shows the gap voltage as a function of the gap distance, where in an exemplary implementation $d_{OPC}$=18 μm and $\in_{r\text{-}OPC}$=3 are assumed. To reach $V_{th}$=1500V within the exemplary 230 μm air gap at seam region 24, charge roller 32 voltage $V_{CR}$ is set to 1540V. Compare the 230 μm air gap with the situation where charge roller 32 is in contact with surface 22 in imaging region 26. Because of the voltage division between the air gap and surface 22, there exists a minimum gap below which gap voltage $V_g$ cannot reach threshold voltage $V_{th}$. The minimum gap is 20 μm, at which $V_{th}$=420V. To reach this threshold, $V_{CR}$=570V is required.

In an exemplary implementation, a charged organic photoconductor has a voltage of approximately $V_{PIP}$=−1000V, and the development rollers 52 have a voltage of approximately $V_{dr}$=−450V. As described above, to reduce the attraction of marking agents to seam region 24, it is desirable to set the charge in seam region 24 at least equal to the charge of development rollers 52. That is, for seam region 24, $V_{PIP} \geqq V_{dr}$=−450V. From knowledge of the developer curve, setting $\Delta V = V_{PIP} - V_{dr} = 0$ results in approximately 20% of the full development. Higher charges in seam region 24 (e.g., where $V_{PIP} > V_{dr}$) will result in even less development in seam region 24. As discussed above, to achieve a certain photoconductor charge level $V_{PIP}$, there is a gap voltage $V_g = V_{th} + V_{PIP}$. Therefore, to charge seam region 24 to $V_{PIP} \geqq V_{dr}$, the gap voltage $V_g = V_{th} + V_{PIP} \geqq -1500V + (-450V) = -1950V$. Using the equation provided above, $V_g$=−1950V translates into a charge roller 32 voltage of $V_{CR}$=−2000V.

Providing a different voltage level $V_{CR}$ to charge roller 32 at seam region 24 requires application of a voltage pulse with a duration of $\Delta t_{seam} = L_{seam}/v_p$, where $L_{seam}$ is the length of seam region 24, and $v_p$ is the speed of surface 22 relative to charge roller 32. In one exemplary implementation, $L_{seam}$=30 mm, and $v_p$=1.2 meters/second, giving $\Delta t_{seam}$=25 milliseconds.

In a direct current (DC) mode, imaging region 26 may be charged using charge roller 32 voltage $V_{CR}$=−1600V. A voltage pulse at seam region 24 changing charge roller 32 voltage to $V_{CR} \geqq -2000V$ for a 25 milliseconds duration will result in charging seam region 24 to a voltage of $V_{PIP} \geqq -450V$, as described above.

In some applications, the cost of a high-voltage DC power supply with the fast response times required may be prohibitively expensive. In such instances, an alternating current (AC) mode can be used to provide the required voltage pulse. In AC mode, in one exemplary implementation, imaging region 26 may be charged using charge roller 32 voltage $V_{CR} = -1040V + 700 \sin(\omega t)V$. As before, a voltage pulse synchronized with seam region 24 changing charge roller 32 voltage to $V_{CR} \geqq -2000V$ for a 25 milliseconds duration will result in charging seam region 24 to a voltage of $V_{PIP} \geqq -450V$. The voltage pulse can be achieved either by increasing the DC voltage or the AC voltage amplitude by 260V or more. Increasing the AC voltage amplitude by 260V or more within a few milliseconds is easier than changing the DC voltage level in a similar amount of time. This is because the AC circuit typically consists of an AC signal generator, transformer and amplifier, all of which have high enough bandwidth for a several millisecond response time. For example, a low cost digital signal processing (DSP) chip can be employed for the AC signal generator, the bandwidth of commonly available transformers is over 1 MHz, and the bandwidth of commonly available amplifiers is up to 20 kHz.

Although, for purpose of clarity, exemplary implementations having specific dimensions, voltages, materials, and process parameters are illustrated and described herein, the invention is understood to be applicable and useful with implementations having dimensions, voltages, materials, and process parameters different than those described herein.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of charging an imaging member, the method comprising:

providing an imaging member having an outer surface with an imaging region and a seam region;

providing a charge roller adjacent the imaging member, including maintaining a substantially constant distance between respective operational axes of the imaging member and the charge roller when the charge roller is adjacent the imaging region of the imaging member and when the charge roller is adjacent the seam region of the imaging member;

providing an electrical charge to the imaging region of the imaging member using a voltage on the charge roller; and providing an other electrical charge to the seam region of the imaging member using an other voltage on the charge roller.

2. The charging method of claim 1, further comprising spacing the charge roller from the imaging member in the seam region while maintaining the substantially constant distance between respective operational axes of the imaging member and the charge roller.

3. The charging method of claim 2, wherein the imaging member is a drum and the charge roller is a single charge roller, and wherein spacing the charge roller from the imaging member in the seam region includes maintaining a substantially constant distance between respective rotational axes of the drum and the single charge roller.

4. The charging method of claim 3, wherein the imaging region and the seam region of the imaging member have different radii.

5. The charging method of claim 4, wherein the imaging region has a radius larger than a radius of the seam region.

6. The charging method of claim 2, wherein spacing the charge roller from the imaging member in the seam region while maintaining the substantially constant distance between respective operational axes of the imaging member and the charge roller comprises:

contacting the charge roller with the outer surface of the imaging member at the imaging region; and providing a space intermediate the charge roller and the outer surface of the imaging member at the seam region.

7. The charging method of claim 2, wherein spacing the charge roller from the imaging member in the seam region comprises providing the seam region in a depression of the outer surface of the imaging member.

8. The charging method of claim 1, wherein the imaging member comprises a photoconductive sheet, and the seam region corresponds to a seam of the photoconductive sheet.

9. A method of charging an imaging member, the method comprising:

providing an imaging member having an outer surface with an imaging region and a seam region;

providing a charge device adjacent the imaging member;

providing an electrical charge to the imaging region of the imaging member using a voltage on the charge device; and providing an other electrical charge to the seam region of the imaging member using an other voltage on the charge device, wherein providing an electrical charge to the imaging region using a voltage on the charge device comprises energizing the charge device with a DC voltage and an AC voltage, and wherein providing an other electrical charge to the seam region of the imaging member using an other voltage on the charge device comprises energizing the charge device with the DC voltage and an other AC voltage.

10. A method of charging an imaging member, the method comprising:

providing an imaging member having an outer surface with an imaging region and a seam region;

providing a charge device adjacent the imaging member;

providing an electrical charge to the imaging region of the imaging member using a voltage on the charge device; and providing an other electrical charge to the seam region of the imaging member using an other voltage on the charge device, wherein providing an other electrical charge to the seam region of the imaging member using an other voltage on the charge device comprises charging the seam region to a voltage larger than a voltage of a subsequent developer roller.

11. An imaging method comprising:

providing an imaging member having an outer surface comprising a plurality of portions having a plurality of different radii;

moving the portions of the outer surface of the imaging member past a charge roller configured to provide an electrical charge to the imaging member;

first controlling a position and voltage of the charge roller with respect to one of the portions of the outer surface of the imaging member at one moment in time;

second controlling a position and voltage of the charge roller with respect to an other of the portions of the outer surface of the imaging member at an other moment in time;

using the charge roller, providing the electrical charge to the one of the portions of the outer surface of the imaging member using one voltage of the charge roller at the one moment in time, and providing the electrical charge to the other of the portions of the outer surface of the imaging member using an other voltage of the charge roller at the other moment in time; and maintaining a substantially constant distance between respective rotational axes of the imaging member and the charge roller at the one moment in time when the charge roller is adjacent the one of the portions of the outer surface of the imaging member and at the other moment in time when the charge roller is adjacent the other of the portions of the outer surface of the imaging member.

12. The imaging method of claim 11, wherein the one of the portions of the outer surface comprises an imaging region and the other of the portions of the outer surface comprises a seam region.

13. The imaging method of claim 11, wherein the imaging member comprises a photoconductive sheet, and the seam region corresponds to a seam of the photoconductive sheet.

14. The imaging method of claim 11, wherein, while maintaining the substantially constant distance between respective rotational axes of the imaging member and the charge roller, the charge roller contacts the one of the portions of the outer surface at the one moment in time, and the charge roller is spaced from the other of the portions of the outer surface at the other moment in time.

15. The imaging method of claim 11, wherein, while maintaining the substantially constant distance between respective rotational axes of the imaging member and the charge roller, the charge roller is spaced a first distance from the one of the portions of the outer surface at the one moment in time, and the charge roller is spaced a second distance from the other of the portions of the outer surface at the other moment in time.

16. The imaging method of claim 11, wherein providing the electrical charge to the one of the portions of the outer surface of the imaging member using one voltage of the charge roller at the one moment in time, and providing the electrical charge to the other of the portions of the outer surface of the imaging member using an other voltage of the charge roller at the other moment in time comprises altering an AC voltage component of the voltage of the charge roller.

17. The imaging method of claim 11, wherein moving the portions of the outer surface of the imaging member past the charge roller comprises moving the outer surface of the imaging member at a speed of 0.3 meter/second or greater.

18. An image transfer device comprising:

an imaging member including an outer surface having an imaging region and a seam region;

a charge roller configured to provide an electrical charge to the outer surface of the imaging member, wherein the outer surface of the imaging member is configured to rotate during imaging operations of the image transfer device and the charge roller is configured to contact the imaging region of the outer surface of the imaging member during the rotation to provide the electrical charge to the imaging region;

a positioning control system configured to provide a space intermediate the charge roller and the outer surface of the imaging member at the seam region and maintain a substantially constant distance between respective operational axes of the imaging member and the charge roller as the charge roller contacts the imaging region and as the charge roller is spaced from the seam region; and a charging control system configured to adjust the voltage of the charge roller at the seam region to provide the electrical charge to the seam region.

19. The image transfer device of claim 18, wherein the imaging member comprises a photoconductive sheet and the seam region corresponds to a seam of the photoconductive sheet, and wherein the charge roller is a single charge roller.

20. The image transfer device of claim 19, wherein the photoconductive sheet is wrapped around a drum, such that the outer surface has different radii corresponding to the imaging region and the seam region.

21. An image transfer device comprising:

an imaging member including an outer surface having an imaging region and a seam region;

a charge device configured to provide an electrical charge to the outer surface of the imaging member, wherein the outer surface of the imaging member is configured to rotate during imaging operations of the image transfer device and the charge device is configured to contact the imaging region of the outer surface of the imaging member during the rotation to provide the electrical charge to the imaging region;

a positioning control system configured to provide a space intermediate the charge device and the outer surface at the seam region;

a charging control system configured to adjust the voltage of the charge device at the seam region to provide the electrical charge to the seam region;

an exposure device configured to electrically discharge selected portions of the electrically charged imaging region to form a latent image; and a development station configured to develop the latent image of the imaging region using a marking agent, wherein the development station comprises a development roller having a development voltage, and wherein the electrical charge provided to the seam region by the charge device is greater than the development voltage.

* * * * *

UNITED STATES PATENT AND TRADEMARK OFFICE

CERTIFICATE OF CORRECTION

PATENT NO. : 7,756,430 B1
APPLICATION NO. : 11/413852
DATED : July 13, 2010
INVENTOR(S) : Seongsik Chang et al.

It is certified that error appears in the above-identified patent and that said Letters Patent is hereby corrected as shown below:

On the Title page, in field (75), Inventors, in column 1, lines 5-6, delete "Palo Alto, CA (US)" and insert -- Rehovot, (IL) --, therefor.

On the Title page, in field (75), inventors, in column 1, line 6, delete "Palo Alto, CA (US)" and insert -- Rehovot, (IL) --, therefor.

Signed and Sealed this
Twenty-second Day of February, 2011

David J. Kappos

David J. Kappos
*Director of the United States Patent and Trademark Office*